US011772920B2

(12) United States Patent
Yasukawa et al.

(10) Patent No.: US 11,772,920 B2
(45) Date of Patent: Oct. 3, 2023

(54) MEDIUM CONVEYING APPARATUS

(71) Applicant: PFU Limited, Ishikawa (JP)

(72) Inventors: Ryoichi Yasukawa, Ishikawa (JP); Naoto Yamaguchi, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 271 days.

(21) Appl. No.: 17/183,898

(22) Filed: Feb. 24, 2021

(65) Prior Publication Data

US 2021/0179372 A1 Jun. 17, 2021

Related U.S. Application Data

(63) Continuation of application No. PCT/JP2018/034691, filed on Sep. 19, 2018.

(51) Int. Cl.
*B65H 5/22* (2006.01)
*B65H 3/12* (2006.01)
*B65H 3/14* (2006.01)

(52) U.S. Cl.
CPC ..... *B65H 3/126* (2013.01); *B65H 3/14* (2013.01); *B65H 5/224* (2013.01)

(58) Field of Classification Search
CPC ..... B65H 5/224; B65H 2404/1321; B65H 2404/631
See application file for complete search history.

(56) References Cited

U.S. PATENT DOCUMENTS 4,381,893 A 5/1983 Silverberg
2011/0163492 A1 7/2011 Taki
2012/0098185 A1 4/2012 Omori
2014/0061999 A1* 3/2014 Okamoto ..... B65H 3/48 271/11
2019/0241381 A1* 8/2019 Furuichi ..... B65H 3/48
2021/0171301 A1* 6/2021 Hirai ..... B65H 3/06

FOREIGN PATENT DOCUMENTS

JP S57-163249 A 10/1982
JP 2000-143012 A 5/2000
JP 2008-68937 A 3/2008
JP 2011-140359 A 7/2011
JP 2012-91881 A 5/2012
JP 2016-130158 A 7/2016
JP 2017-132552 A 8/2017
JP 2018-131302 A 8/2018

OTHER PUBLICATIONS

International Search Report issued in corresponding International Patent Application No. PCT/JP2018/034691, dated Dec. 11, 2018, with English translation.

* cited by examiner

*Primary Examiner* — Howard J Sanders
(74) *Attorney, Agent, or Firm* — McDermott Will & Emery LLP

(57) ABSTRACT

A medium conveying apparatus includes a suctioner that suctions a medium of a plurality of media to a feed belt, a driver that moves the feed belt to feed the medium, a first side blower that blows air at a first airflow rate to a first end face of the medium, a second side blower that blows air at a second airflow rate to a second end face of the medium, and a controller that controls the first side blower to blow air to the first end face at a third airflow rate that is greater than the first airflow rate and the second airflow rate when the medium has not been auctioned to a first portion of the feed belt close to the first end face and has been auctioned to a second portion of the feed belt close to the second end face.

4 Claims, 15 Drawing Sheets

MEDIUM CONVEYING APPARATUS

CROSS-REFERENCE TO RELATED APPLICATION

This application is a continuation of International Application No. PCT/JP2018/034691, filed on Sep. 19, 2013, the entire contents of which are incorporated herein by reference.

FIELD

The embodiments discussed herein are related to a medium conveying apparatus.

BACKGROUND

It is popular to computerize, with use of a scanner device, a plurality of media that are put in a binder. The media put in the binder sometimes include a bound medium that is formed of a plurality of paper documents bound with a staple or a clip. An apparatus that feeds a single bound medium from among a plurality of bound media stacked on a document table, and automatically removes a staple from the fed bound medium has been known. Further, an apparatus that, when feeding a single medium from among a plurality of media stacked on a document table, blows air to end faces of the plurality of media such that the single medium to be fed is appropriately floated has been known (see Japanese Laid-open Patent. Publication No. 2016-130158 and Japanese Laid-open Patent Publication No. 2017-132552).

However, bound media are bound with staples at different positions and portions in which the staples are arranged are less likely to be floated; therefore, in some cases, it may be difficult to appropriately feed the sets of bound media.

SUMMARY

According to an aspect of an embodiment, a medium conveying apparatus includes a feed belt, a suctioner with which a medium of a plurality of media stacked on a document table is auctioned to the feed belt, a driver that moves the feed belt to feed the medium when the medium is being suctioned to the feed belt, a first side blower that blows air at a first airflow rate to a first end face of the medium, a second side blower that blows air at a second airflow rate to a second end face opposite to the first end face of the medium, a first sensor that detects whether the medium has been suctioned to a first portion of the feed belt close to the first end face, a second sensor that detects whether the medium has been suctioned to a second portion of the feed belt close to the second end face, and a controller that controls the first side blower to blow air at a third airflow rate greater than the first airflow rate and the second airflow rate to the first end face when the second sensor detects that the medium has been suctioned to the second portion and the first sensor detects that the medium has not been suctioned to the first portion.

The object and advantages of the disclosure will be realized and attained by means of the elements and combinations particularly pointed out in the claims.

It is to be understood that both the foregoing general description and the following detailed description are exemplary and explanatory and are not restrictive of the disclosure.

BRIEF DESCRIPTION OF DRAWINGS

FIG. 3 is a block diagram illustrating the image reading apparatus including the medium conveying apparatus of the first embodiment;

DESCRIPTION OF EMBODIMENTS

Preferred embodiments of the disclosure will be explained with reference to accompanying drawings. Embodiments of a medium conveying apparatus disclosed in the present application will be described below with reference to the drawings. The present disclosure is not limited by the description below. In addition, in the following description, the same components are denoted by the same reference symbols, and the repeated explanation thereof will be omitted.

First Embodiment

Figure 1:
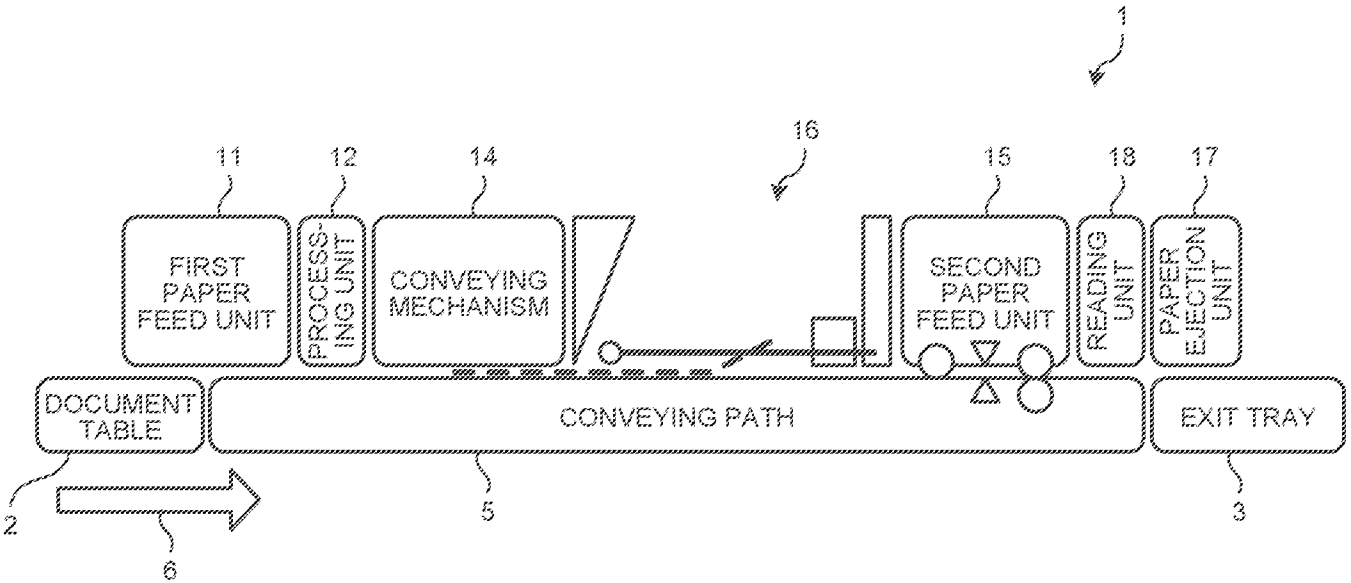
FIG. 1 is a schematic side view of an image reading apparatus including a medium conveying apparatus of a first embodiment.

As illustrated in FIG. 1, a medium conveying apparatus of the first embodiment is used in an image reading apparatus 1. FIG. 1 is a schematic side view of the image reading apparatus 1 including the medium conveying apparatus of the first embodiment. The image reading apparatus 1 includes a document table 2, an exit tray 3, and a conveying path 5. A medium is stacked on the document table 2. The exit tray 3 is arranged on a downstream side of the document table 2 in a conveying direction 6. The conveying direction 6 is approximately parallel to a plane along an installation surface on which the image reading apparatus 1 is installed. The conveying path 5 is arranged between the document table 2 and the exit tray 3 and forms a pathway that connects the document table 2 and the exit tray 3. The conveying path 5 guides a medium fed to the conveying path 5 such that the medium fed to the conveying path 5 is conveyed to the downstream side in the conveying direction 6 along the pathway.

The image reading apparatus 1 further includes a first paper feed unit 11, a processing unit 12, a conveying mechanism 14, a second paper feed unit 15, an unfolding unit 16, a paper ejection unit 17, and a reading unit 18. The first paper feed unit 11 is arranged at an end of the conveying path 5 at the side of the document table 2. The first paper feed unit 11 detects whether a medium is stacked on the document table 2. When a plurality of media are stacked on the document table 2, the first paper feed unit 11 feeds a single medium arranged on the topmost side among the plurality of media stacked or the document table 2 to the conveying path 5 and supplies the medium fed from the document table 2 to the conveying path 5 to the processing unit 12. When a single medium is stacked on the document table 2, the first paper feed unit 11 feeds the medium to the conveying path 5 and supplies the medium fed from the document table 2 to the conveying path 5 to the processing unit 12.

The processing unit 12 is arranged on a downstream side of the first paper feed unit 11 on the conveying path 5, that is, arranged between the first paper feed unit 11 on the conveying path 5 and the exit tray 3. The processing unit 12 detects whether the medium supplied from the first paper feed unit 11 is a single sheet of medium or a bound medium. The single sheet of medium is formed of a single sheet of paper. The bound medium is formed by binding a plurality of sheets of paper with a binding member. Examples of the binding member include a staple.

If it is detected that the medium supplied from the first paper feed unit 11 is a single sheet of medium, the processing unit 12 supplies the single sheet of medium as it is to the conveying mechanism 14, and, if it is detected that the medium supplied from the first paper feed unit 11 is a bound medium, the processing unit 12 removes a binding member from the bound medium to generate a plurality of sheets of media, and supplies the generated plurality of sheets of media to the conveying mechanism 14.

The conveying mechanism 14 is arranged on a downstream side of the processing unit 12 on the conveying path 5, that is, arranged between the processing unit 12 and the exit tray 3 on the conveying path. The conveying mechanism 14 supplies the medium supplied from the processing unit 12 to the second paper feed unit 15.

The second paper feed unit 15 is arranged on the downstream side of the conveying mechanism 14 on the conveying path 5, that is, arranged between the conveying mechanism 14 and the exit tray 3 on the conveying path 5. The second paper feed unit 15 supplies the medium supplied from the conveying mechanism 14 to the reading unit 18.

The unfolding unit 16 is arranged between the conveying mechanism 14 and the second paper feed unit 15 on the conveying path 5. If the medium conveyed between the conveying mechanism 14 and the second paper feed unit 15 is a Z-folded medium, the unfolding unit 16 unfolds the Z-folded medium into an approximately flat shape.

The paper ejection unit 17 is arranged at an end of the conveying path 5 at the side of the exit tray 2, that is, arranged on a downstream side of the second paper feed unit 15 on the conveying path 5. The paper ejection unit 17 stacks the medium supplied from the second paper feed unit 15 onto the exit tray 3.

The reading unit 18 is arranged between the second paper feed unit 15 and the paper ejection unit 17 on the conveying path 5. The reading unit 18 reads images on both sides of the medium that is conveyed between the second paper feed unit 15 and the paper ejection unit 17 on the conveying path 5.

Figure 2:
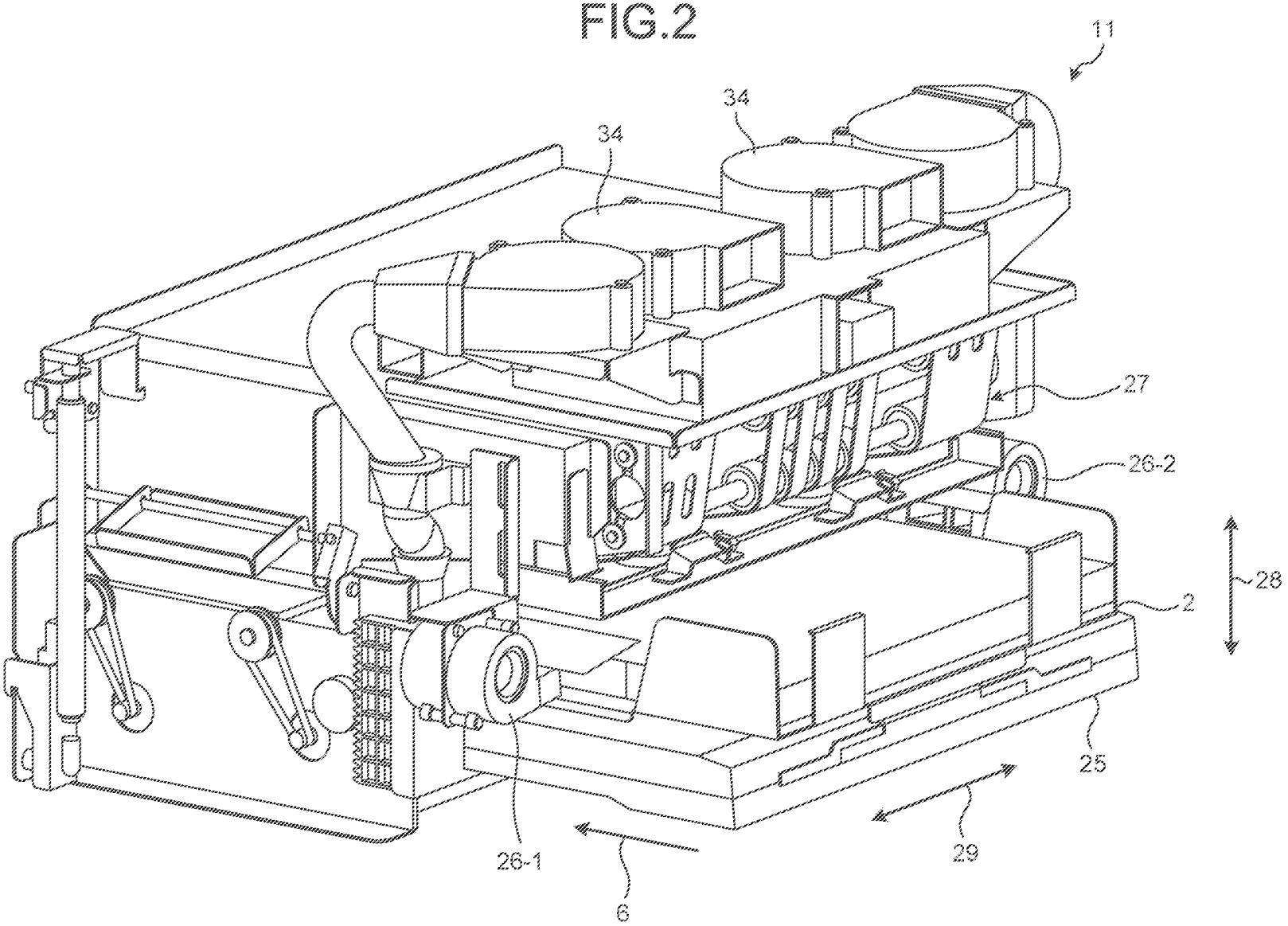
FIG. 2 is a perspective view illustrating a first paper feed unit of the medium conveying apparatus of the first embodiment.

FIG. 2 is a perspective view illustrating the first paper feed unit 11 of the medium conveying apparatus of the first embodiment. The first paper feed unit 11 includes a document table driver 25, a first side blower 26-1, a second side blower 26-2, and a plurality of feed belts 21. The document table driver 25 is arranged under the document table 2 and translates the document table 2 up and down in vertical direction 28. The vertical direction 28 is perpendicular to a plane along the installation surface on which the image reading apparatus 1 is installed.

The first side blower 26-1 is arranged on one side of the document table 2 in a width direction. A width direction 23 is parallel to the plane along the installation surface of the image reading apparatus 1 and perpendicular to the conveying direction 6. The first side blower 26-1 blows air to one end face of a medium in the width direction 29 when the medium is stacked on the document table 2. The first side blower 26-1 is switched to any of a first airflow rate mode, a third airflow rate mode, and a fifth airflow rate mode. A third airflow rate is greater than a first airflow mode, and a fifth airflow rate is greater than the third airflow rate.

The second side blower 26-2 is arranged on the other side of the document table 2 in the width direction 29. The second side blower 26-2 blows air to the other end face of the medium in the width direction 29 when the medium is stacked on the document table 2. The second side blower 26-2 is switched to any of a second airflow rate mode, a fourth airflow rate mode, and a sixth airflow rate mode. A second airflow rate is approximately equal to the first airflow rate. A fourth airflow rate is greater than the second airflow rate, and a sixth airflow rate is greater than the fourth airflow rate.

Each of the feed belts 27 is made of a flexible material and formed as a loop-shape band. The plurality of feed belts 27 are arranged above the document table 2 in the vertical direction 28.

Figure 3:
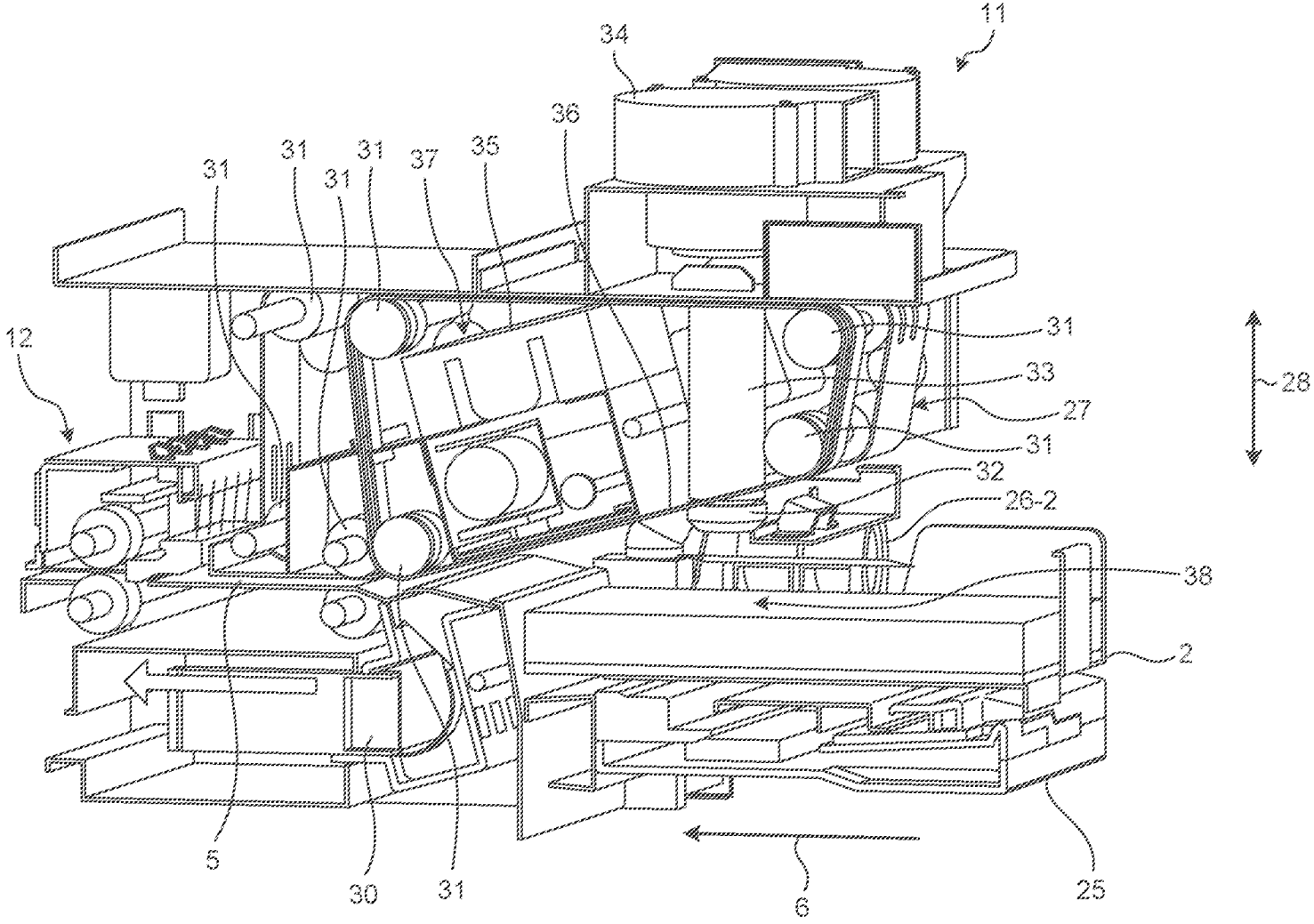
FIG. 3 is a cross-sectional view of the first paper feed unit of the medium conveying apparatus of the first embodiment.

FIG. 3 is a cross-sectional view of the first paper feed unit 11 of the medium conveying apparatus of the first embodiment. The first paper feed unit 11 includes a separation blower 30, a plurality of fixed pulleys 31, a plurality of suction pads 32, a suction pad driver 33, a plurality of suction pad blowers 34, and a conveying blower 35. The separation blower 30 is arranged on a downstream side of the document table 2 in the conveying direction 6. The separation blower 30 is arranged on the downstream side of the document table 2 in the conveying direction 6 and blows air to a downstream end face in the conveying direction 6 of the medium stacked on the document table 2.

The plurality of feed belts 27 are movably stretched around the plurality of fixed pulleys 31, and accordingly, a lower portion 36 is formed. The lower portion 36 separates an area 37 enclosed by the plurality of feed belts 27 and a space 38 between the plurality of feed belts 27 and the document table 2.

The plurality of suction pads 32 are supported by the conveying path 5 so as to be able to move up and down in the vertical direction 28. The suction pad driver 33 is formed of an actuator and moves the plurality of suction pads 32 up and down in the vertical direction 28. The plurality of suction pad blowers 34 are connected to the plurality of suction pads 32. The conveying blower 35 is arranged in the area 37 enclosed by the plurality of feed belts 27.

Figure 4:
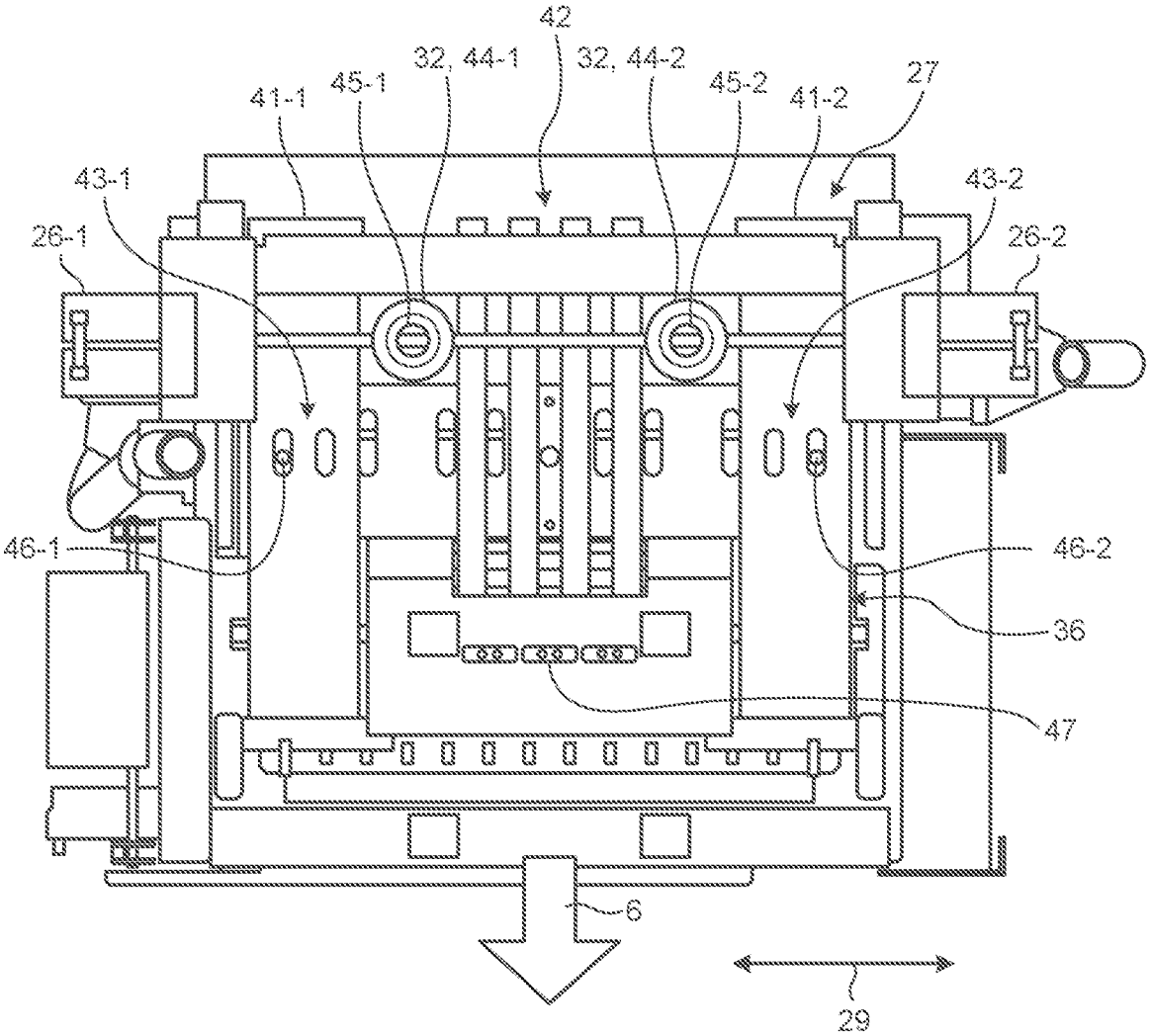
FIG. 4 is a bottom view of the first paper feed unit of the medium conveying apparatus of the first embodiment.

FIG. 4 is a bottom view of the first paper feed unit 11 of the medium conveying apparatus of the first embodiment. The plurality of feed belts 27 include a first feed belt 41-1, a second feed belt 41-2, and a plurality of central feed belts 42. The first feed belt 41-1 is arranged at a side close to the first side blower 26-1 and includes a plurality of first belt air inlets 43-1. The second feed belt 41-2 is arranged at a side close to the second side blower 26-2 and includes a plurality of second belt air inlets 43-2. The plurality of central feed belts 42 are arranged between the first feed belt 41-1 and the second feed belt 41-2.

The plurality of suction pads 32 include a first suction pad 44-1 and a second suction pad 44-2. The first suction pad 44-1 is arranged between the first feed belt 41-1 and the plurality of central feed belts 42, and includes a first pad air inlet 45-1. The second suction pad 44-2 is arranged between the second feed belt 41-2 and the plurality of central feed belts 42, and includes a second pad air inlet 45-2. The plurality of suction pad blowers 34 are connected to the plurality of suction pads 32 and suck air via the first pad air inlet 45-1 and the second pad air inlet 45-2.

The first, paper feed unit 11 includes a first suction detection sensor 46-1, a second suction detection sensor 46-2, and a paper detection sensor 47. The first suction detection sensor 46-1 is arranged in the vicinity of the lower portion 36 of the first feed belt 41-1 in the area 37, and detects whether the medium has been suctioned to the lower portion 36 of the first feed belt 41-1. The second suction detection sensor 46-2 is arranged in the vicinity of the lower portion 36 of the second feed belt 41-2 in the area 37, and detects whether the medium has been suctioned to the lower portion 36 of the second feed belt 41-2.

The paper detection sensor 47 is arranged on the downstream side in the conveying direction 6 of the plurality of central feed belts 42 located above the conveying path 5, and detects whether the medium has been located at a predetermined position on the downstream side in the conveying direction of the plurality of central feed belts 42 on the conveying path 5. The processing unit 12 is able to convey the medium located at the predetermined position.

Figure 5:
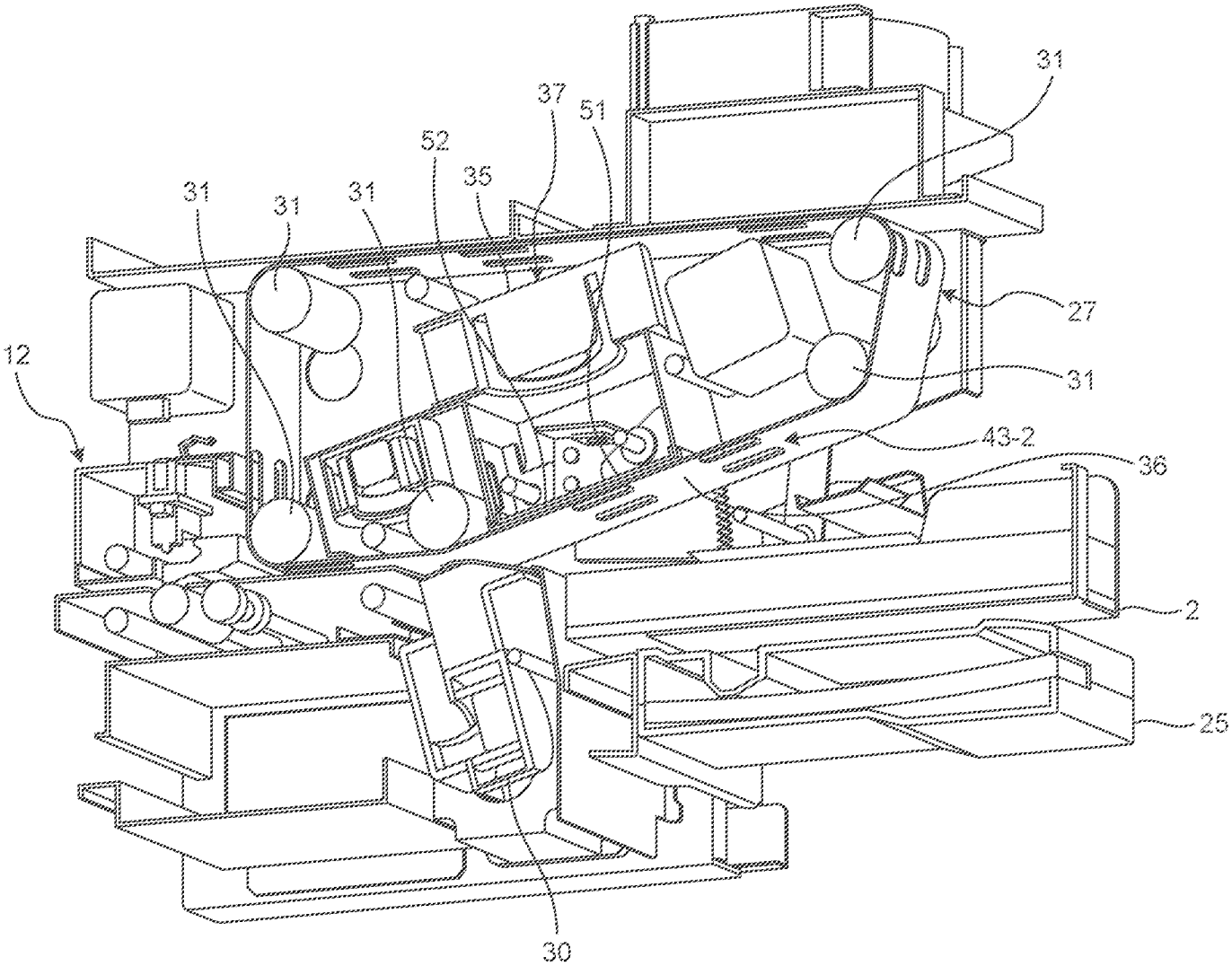
FIG. 5 is another cross-sectional view of the first paper feed unit of the medium conveying apparatus of the first embodiment.

FIG. 5 is another cross-sectional view of the first paper feed unit 11 of the medium conveying apparatus of the first, embodiment. The first paper feed unit 11 further includes an upper conveying guide 51 and a plurality of shutters 52. The upper conveying guide 51 is formed in a flat plate shape. The upper conveying guide 51 is arranged in the area 37 so as to be located along the lower portion 36 of the plurality of feed belts 27 and fixed to the conveying path 5. The plurality of shutters 52 are formed in flat plate shapes. The plurality of shutters 52 are arranged between the lower portion 36 and the upper conveying guide 51 so as to be located along the lower portion 36 of the plurality of feed belts 27. The plurality of shutters 52 are further supported so as to be able to move translationally in parallel to the width direction 29.

Figure 6:
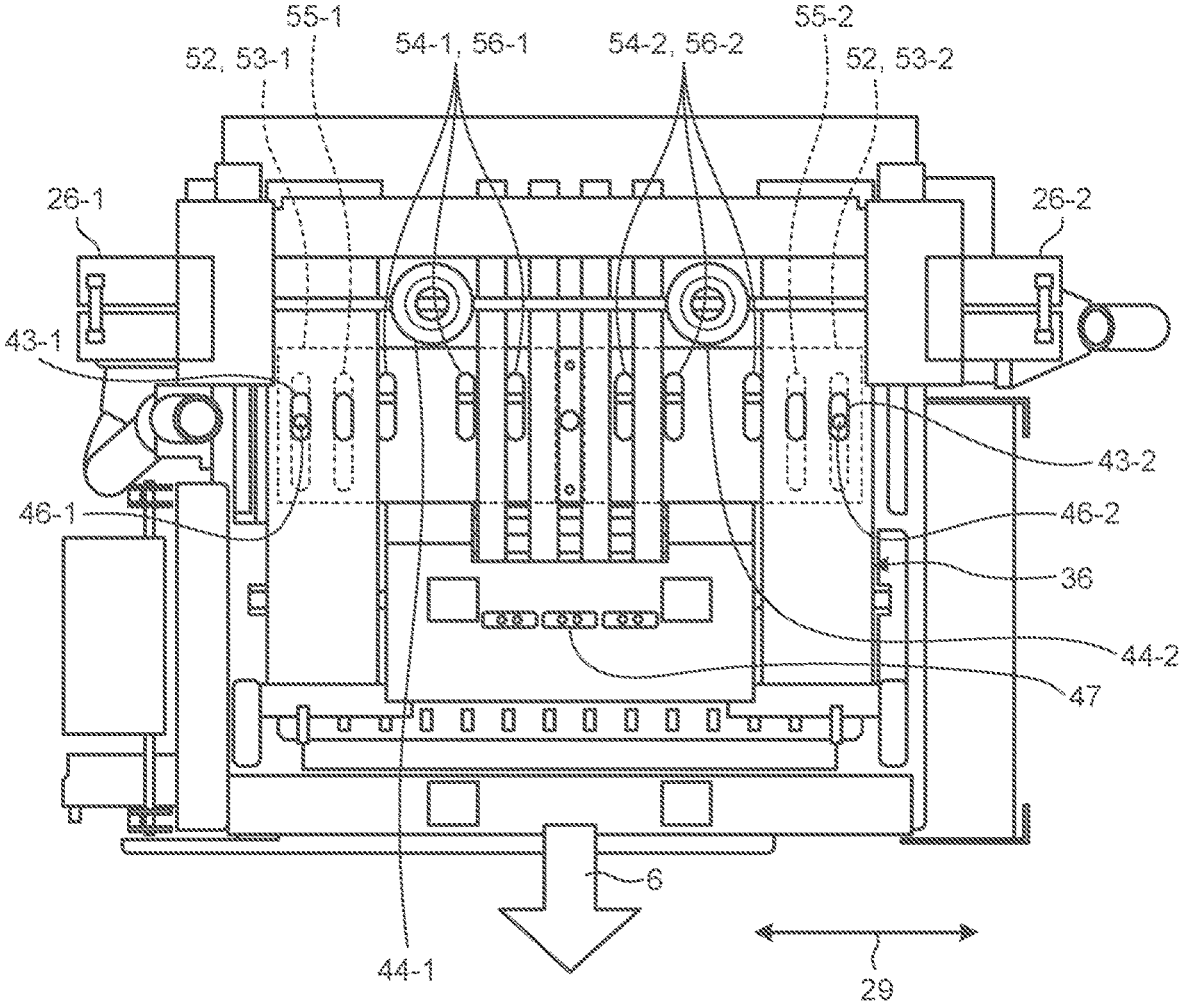
FIG. 6 is another bottom view of the first paper feed unit of the medium conveying apparatus of the first embodiment.

FIG. 6 is another bottom view of the first paper feed unit 11 of the medium conveying apparatus of the first embodiment. The plurality of shutters 52 include a first shutter 53-1 and a second shutter 53-2. The first shutter 53-1 is arranged on the downstream side of the first suction pad 44-1 in the conveying direction 6 and includes a plurality of first guide air inlet communication holes 54-1 and a plurality of first belt air inlet communication holes 55-1. The first shutter 53-1 is supported to be able to move translationally with respect to the conveying path 5 such that the first shutter 53-1 can be located at a first opening position or a first closing position. The second shutter 53-2 is arranged on the downstream side of the second suction pad 44-2 in the conveying direction 6 and includes a plurality of second guide air inlet communication holes 54-2 and a plurality of second belt air inlet, communication holes 55-2. The second shutter 53-2 is supported to be able to move translationally with respect to the conveying path 5 such that the second shutter 53-2 can be located at a second opening position or a second closing position.

The upper conveying guide 51 includes a plurality of first guide air inlets 56-1 and a plurality of second guide air inlets 56-2. The plurality of first guide air inlets 56-1 are arranged in portions that overlap with the first shutter 53-1 on the upper conveying guide 51 and do not overlap with the lower portion 36 of the plurality of feed belts 27. The plurality of second guide air inlets 56-2 are arranged in portions that overlap with the second shutter 53-2 on the upper conveying guide 51 and do not overlap with the lower portion 36 of the plurality of feed belts 27. The upper conveying guide 51 further includes a first belt communication hole and a second belt communication hole (not illustrated). The first belt communication hole communicates with a first belt air inlet formed in the lower portion 36 of the plurality of first belt air inlets 43-1. The second belt communication hole communicates with a second belt air inlet formed in the lower portion 36 of the plurality of second belt air inlets 43-2.

The plurality of first guide air inlets 56-1 communicate with the plurality of first guide air inlet communication holes 54-1 and are opened when the first shutter 53-1 is located at the first opening position. The first belt air inlet formed in the lower portion 36 of the plurality of first belt air inlets 43-1 communicates with the plurality of first belt air inlet communication holes 55-1 and is opened when the first shutter 53-1 is located at the first opening position. The plurality of second guide air inlets 56-2 communicate with the plurality of second guide air inlet communication holes 54-2 and are opened when the second shutter 53-2 is located at the second opening position. The second belt air inlet formed in the lower portion 36 of the plurality of second belt air inlets 43-2 communicates with the plurality of second belt air inlet communication holes 55-2 and is opened when the second shutter 53-2 is located at the second opening position. At this time, the conveying blower 35 sucks air from the space 38 via the plurality of first guide air inlets 56-1, the plurality of second guide air inlets 56-2, the plurality of first belt air inlets 43-1, and the plurality of second belt air inlets 43-2.

Figure 7:
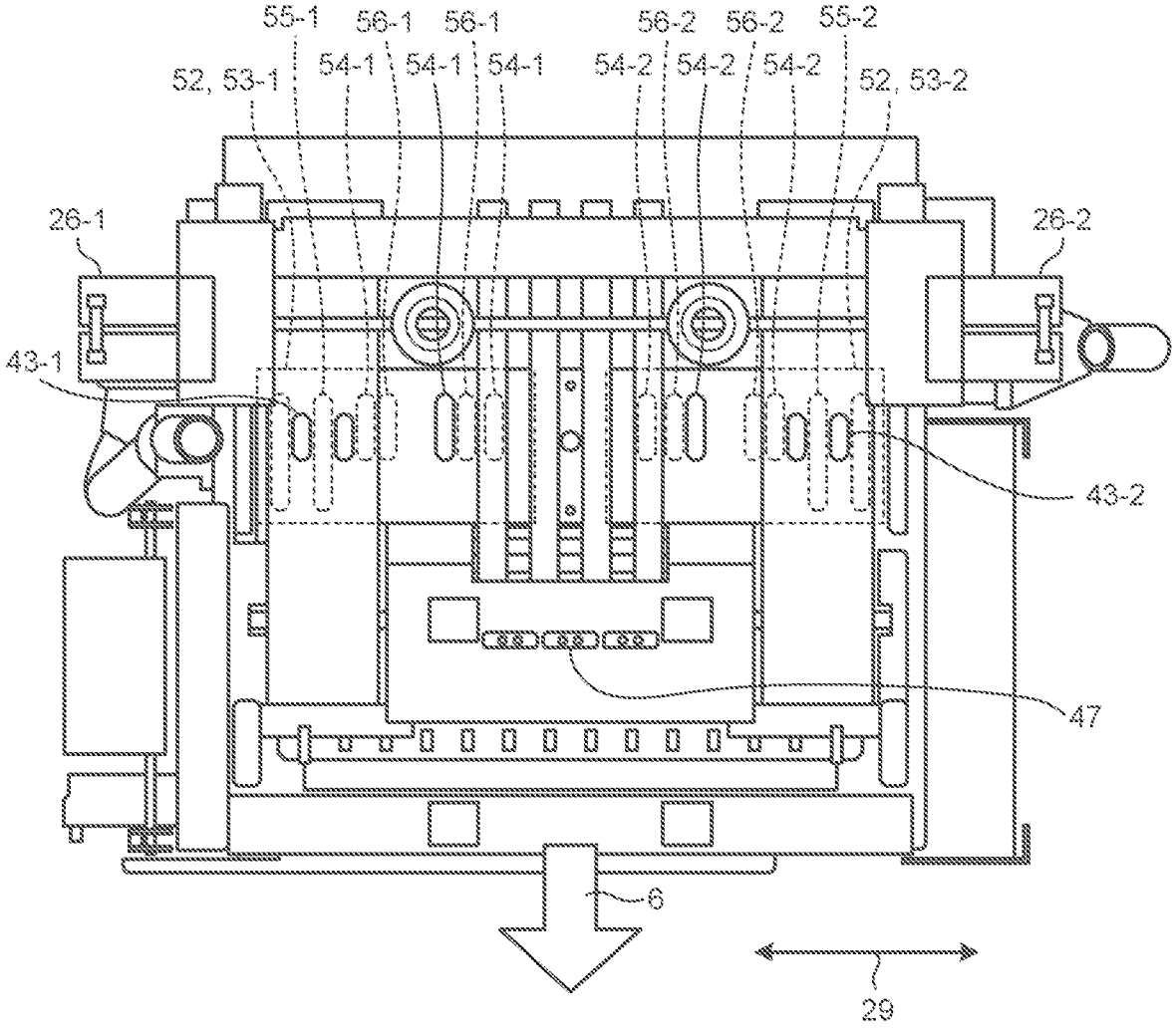
FIG. 7 is a bottom view of the first paper feed unit of the medium conveying apparatus of the first embodiment when a first shutter is located at a first closing position and a second shutter is located at a second closing position.

FIG. 7 is a bottom view of the first paper feed unit 11 of the medium conveying apparatus of the first embodiment when the first shutter 53-1 is located at the first closing position and the second shutter 53-2 is located at the second closing position. When the first shutter 53-1 is located at the first closing position, the plurality of first guide air inlets 56-1 are closed by overlapping with a portion of the first shutter 53-1 where the plurality of first guide air inlet communication holes 54-1 are not formed. When the first shutter 53-1 is located at the first closing position, the first belt air inlet formed in the lower portion 36 of the plurality of first belt air inlets 43-1 is closed by overlapping with a portion other than the plurality of first belt air inlet communication holes 55-1 of the first shutter 53-1. When the second shutter 53-2 is located at the second closing position, the plurality of second guide air inlets 56-2 is closed by overlapping with a certain portion of the second shutter 53-2 where the plurality of second guide air inlet communication holes 54-2 are not formed. When the second shutter 53-2 is located at the second closing position, the second belt air inlet formed in the lower portion 36 of the plurality of second belt air inlets 43-2 is closed by overlapping with a portion other than the plurality of second belt air inlet communication holes 55-2 of the second shutter 53-2. At this time, even if the conveying blower 35 is activated, air in the space 38 is not sucked via the plurality of first guide air inlets 56-1, the plurality of second guide air inlets 56-2, the plurality of first belt air inlets 43-1, and the plurality of second belt air inlets 43-2.

Figure 8:
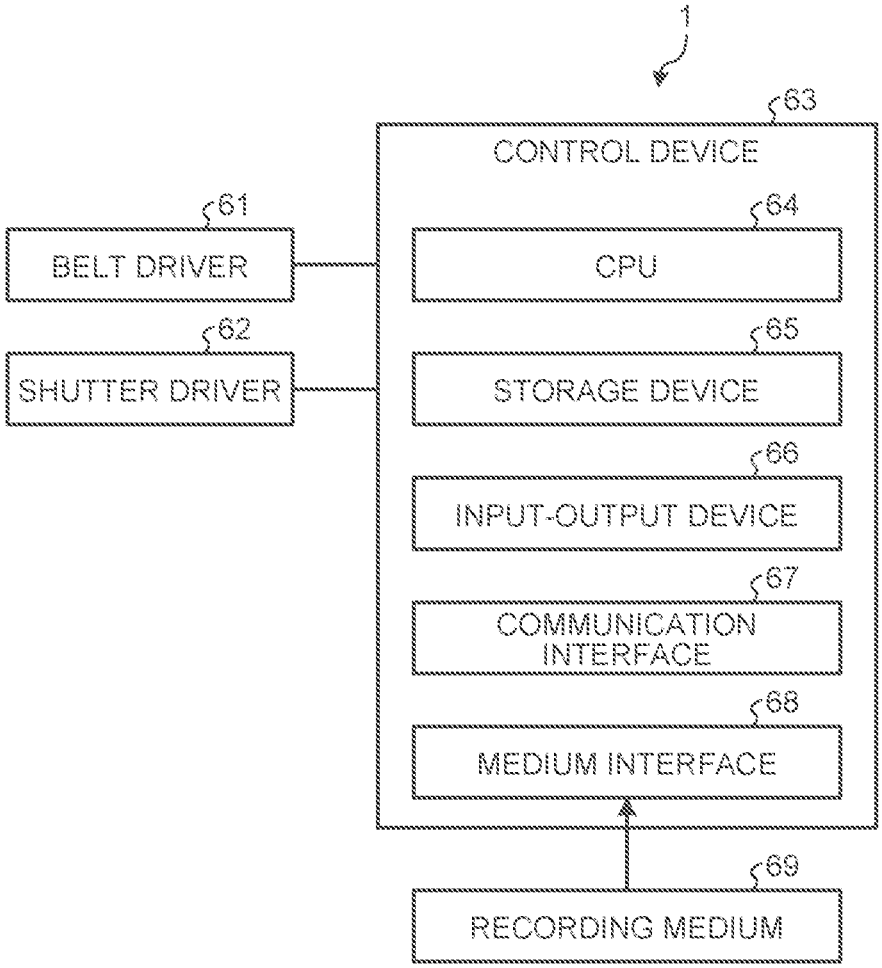
Figure 9:
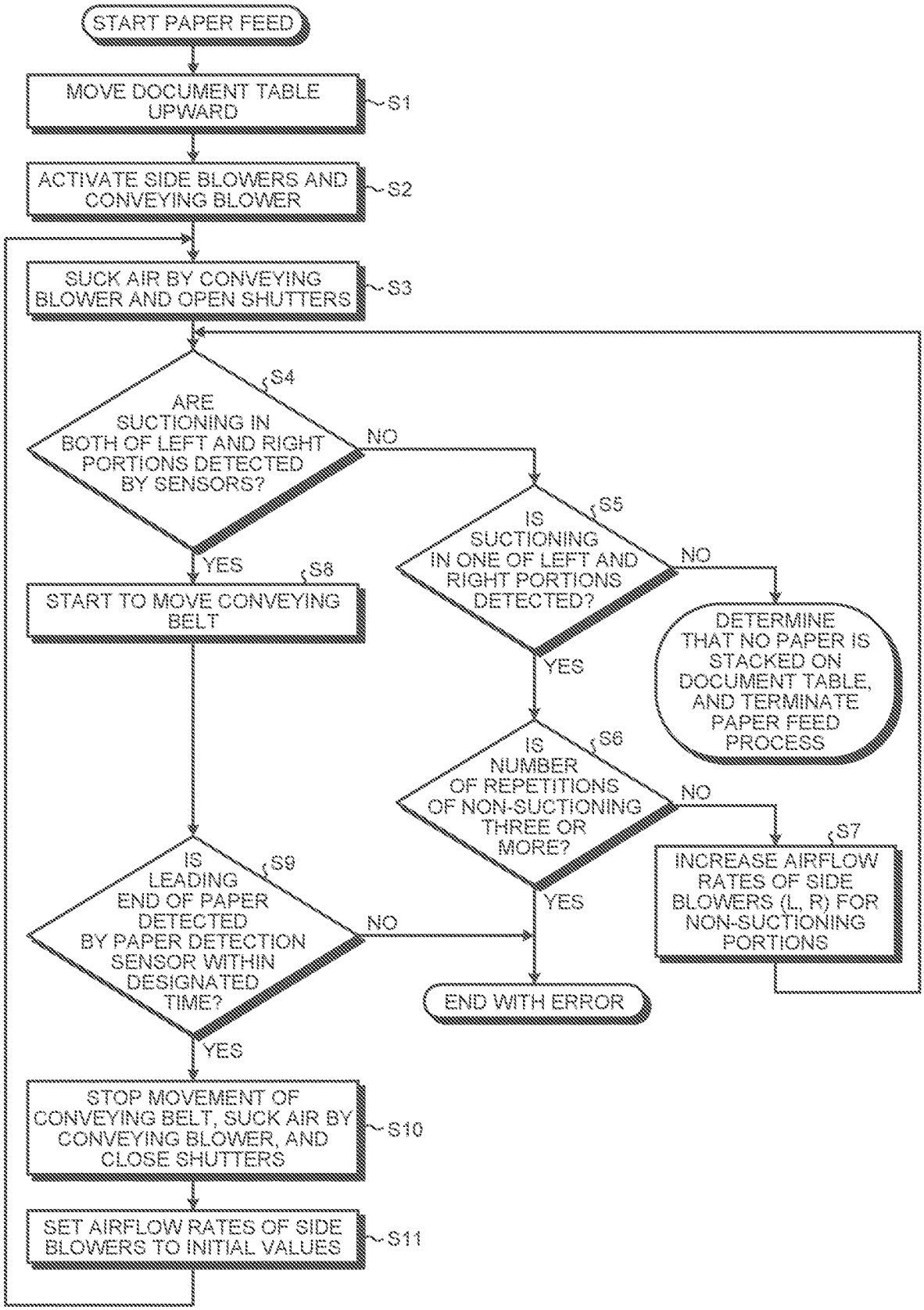
FIG. 9 is a flowchart illustrating operation performed by the first paper feed unit of the medium conveying apparatus of the first embodiment.

As illustrated in FIG. 8, the image reading apparatus 1 further includes a belt driver 61, a shutter driver 62, and a control device 63. FIG. 8 is a block diagram illustrating the image reading apparatus 1 including the medium conveying apparatus of the first embodiment. The control device 63 controls the belt driver 61 to rotate the plurality of fixed pulleys 31 such that the plurality of feed belts 27 move. The control device 63 controls the shutter driver 62 to move the first shutter 53-1 and the second shutter 53-2.

The control device 63 is a computer and includes a central processing unit (CPU) 64, a storage device 65, an input-output device 66, a communication interface 67, and a medium interface 68. The CPU 64 executes a computer program installed in the control device 63 to perform information processing and control the storage device 65, the input-output device 66, the communication interface 67, and the medium interface 68. The CPU 64 executes a computer program installed in the control device 63 to further control each of elements provided in the image reading apparatus 1. Examples of the storage device 65 include a memory, such as a random access memory (RAM) or a read only memory (ROM), a fixed disk device, such as a hard disk, and a solid state drive (SSD). The storage device 65 records therein the computer programs installed in the control device 63, and records therein information used by the CPU 64. The input-output device 66 outputs information generated through operation performed by a user to the CPU 64, and outputs information generated by the CPU 64 such that the information can be recognized by the user.

The CPU 64 controls the communication interface 67 and downloads information from other computer connected via a communication line to the control device 63 or transmits information from the control device 63 to other computers. The medium interface 68 is formed to be able to load a non-transitory tangible recording medium 69. Examples of the recording medium 69 include a semiconductor memory, a magnetic disk, a magneto optical disk, and an optical disk. When the recording medium 69 is loaded, the CPU 64 controls the medium interface 68 and reads information from the recording medium 69 or record information to the recording medium 69. Meanwhile, the computer programs installed in the control device 63 may be downloaded from other computers via the communication interface 67, or may be read from the recording medium 69 via the medium interface 68, Operation of Image Reading Apparatus 1

When a user attempts to read images from a plurality of media by using the image reading apparatus 1, the user stacks the plurality of media on the document table 2 and operates the input-output device 66 of the control device 63 to activate the image reading apparatus 1. The plurality of media stacked on the document table 2 includes a single sheet of medium or a bound medium. In some cases, the single sheet of medium nay be a Z-folded medium that is folded in a Z-shape. If the image reading apparatus 1 is activated, the control device 63 controls the first paper feed unit 11 to detect whether media are stacked on the document table 2. If the control device 63 detects that the media are stacked on the document table 2, the control device 63 controls the first paper feed unit 11 to feed a single medium arranged on the topmost side among the plurality of media stacked on the document table 2 to the conveying path 5, and supplies the fed medium to the processing unit 12.

The control device 63 further controls the processing unit 12 to detect whether the medium supplied from the first paper feed unit 11 is a bound medium or a single sheet of medium. If it is detected that the medium supplied from the first paper feed unit 11 is a single sheet of medium, the control device 63 controls the processing unit 12 to supply the single sheet of medium as it is to the conveying mechanism 14, and if it is detected that the medium supplied from the first paper feed unit 11 is a bound medium, the control device 63 controls the processing unit 12 to remove a binding member from the bound medium.

The unfolding unit 16 unfolds the medium when the medium conveyed between the conveying mechanism 14 and the second paper feed unit 15 is Z-folded. That is, the Z-folded medium conveyed from the conveying mechanism 14 to the second paper feed unit 15 is unfolded by passing through the unfolding unit 16, and thereafter supplied to the second paper feed unit 15. When the medium is supplied from the second paper feed unit 15 to the paper ejection unit 17, the control device 63 controls the reading unit 18 to read images on both sides of the medium conveyed from the second paper feed unit 15 to the paper ejection unit 17 and record the read images. The control device 63 controls the paper ejection unit 17 to stack the medium supplied from, a separating unit 22 to the paper ejection unit 17 onto the exit tray 3.

The control device 63 repeats the operation as described above until the first, paper feed unit 11 detects that no medium is stacked on the document table 2. By repeating the operation as described above, the image reading apparatus 1 is able to read respective images of a plurality of media that are stacked on the document table 2.

FIG. 3 is a flowchart illustrating operation performed by the first paper feed unit 11 of the medium conveying apparatus of the first, embodiment. If the image reading apparatus 1 is activated, the control device 63 controls the document table driver 25 to move the document table 2 upward in the vertical direction 28 (Step S1). If the image reading apparatus 1 is activated, the control device 63 further activates the first side blower 26-1, the second side blower 26-2, and the conveying blower 35 (Step 32). If the first side blower 26-1 is activated, the first side blower 26-1 blows air to end faces of the plurality of media at the side close to the first side blower 26-1 while the media are stacked on the document table 2. If the second side blower 26-2 is activated, the second side blower 26-2 blows air to end faces of the plurality of media at the side close to the second side blower 26-2 while the media are stacked on the document table 2. The control device 63 further controls the belt driver 61 to expose the first suction detection sensor 46-1 to the space 38 via the plurality of first belt air inlets 43-1, and expose the second suction detection sensor 46-2 to the space 38 via the plurality of second belt air inlets 43-2.

The control device 63 controls the shutter driver 62 to locate the first shutter 53-1 at the first opening position and the second shutter 53-2 at the second opening position. The plurality of first guide air inlets 56-1 and the plurality of first belt air inlets 43-1 are opened when the first shutter 53-1 is located at the first opening position. The plurality of second guide air inlets 56-2 and the plurality of second belt air inlets 43-2 are opened when the second shutter 53-2 are located at the second opening position. The conveying blower 35 sucks air from the space 38 via the plurality of first guide air inlets 56-1, the plurality of first belt air inlets 43-1, the plurality of second guide air inlets 56-2, and the plurality of second belt air inlets 43-2 (Step S3).

The control device 63 further controls the plurality of suction pad blowers 34 to suck air via the first pad air inlet 45-1 of the first suction pad 44-1 and the second pad air inlet 45-2 of the second suction pad 44-2. The control device 83 further, controls the suction pad driver 33 to move the plurality of suction pads 32 downward such that the plurality of suction pads 32 come into contact with a medium that is arranged on the topmost side among the plurality of media stacked on the document table 2. The medium contacted with the plurality of suction pads 32 is suctioned to the plurality of suction pads 32. After the medium is suctioned to the plurality of suction pads 32, the control device 63 controls the suction pad driver 33 to move the plurality of suction pads 32 upward. The medium being suctioned to the plurality of suction pads 32 comes into contact with the lower portion 36 of the plurality of feed belts 27 due to upward movement of the plurality of suction pads 32. The medium contacted with the lower portion 36 is suctioned to the lower portion 36 of the plurality of feed belts 27 by the conveying blower 35.

After the plurality of suction pads 32 moved upward, the control device 63 controls the first suction detection sensor 46-1 to detect whether the medium is suctioned to the lower portion 36 of the first feed belt 41-1, and controls the second suction detection sensor 46-2 to detect whether the medium is suctioned to the lower portion 36 of the second feed belt 41-2 (Step S4). If the control device 63 detects that the medium is not suctioned to both of the first feed belt 41-1 and the second feed belt 41-2 (No at Step S4 and No at Step S5), the control device 63 determines that no medium is stacked on the document table 2.

If the control device 63 detects that the medium is not suctioned to the first feed belt 41-1, and detects that the medium is suctioned to the second feed belt 41-2 (Yes at Step S5), the control device 63 detects a mode of the first side blower 26-1. If the first side blower 26-1 has been switched to the first airflow rate mode (No at Step S6), the control device 63 switches the first side blower 26-1 to the third airflow rate mode to blow air at the third airflow rate to the medium (Step S7). If the first side blower 26-1 has been switched to the third airflow rate mode (No at Step S6), the control device 63 switches the first side blower 26-1 to the fifth airflow rate mode to blow air at the fifth airflow rate to the medium (Step S7). If the first side blower 26-1 has been switched to the fifth airflow rate mode (Yes at Step S6), the control device 63 controls the input-output device 66 to notify the user that an error has occurred.

If the control device 63 detects that the medium is not suctioned to the second feed belt 41-2, and detects that the medium is auctioned to the first feed belt 41-1 (Yes at Step S5), the control device 63 detects a mode of the second side blower 26-2. If the second side blower 26-2 has been switched to the second airflow rate mode (No at Step S6), the control device 63 switches the second side blower 26-2 to the fourth airflow rate mode to blow air at the fourth airflow rate to the medium (Step S7). If the second side blower 26-2 has been switched to the fourth airflow rate mode (No at Step S6), the control device 63 switches the second side blower 26-2 to the sixth airflow rate mode to blow air at the sixth airflow rate to the medium (Step S7). If the second side blower 26-2 has been switched to the sixth airflow rate mode (Yes at Step S6), the control device 63 controls the input-output device 66 to notify the user that an error has occurred.

After the process at Step S7 is performed, the control device 63 repeatedly performs the processes from Step S4. If the control, device 63 detects that the medium is suctioned to both of the first feed belt 41-1 and the second feed belt 41-2 (Yes at Step S4), the control device 63 controls the belt driver 61 to move the plurality of feed belts 27 (Step S8). The medium suctioned to the plurality of feed belts 27 is conveyed to the downstream side in the conveying direction 6 due to movement of the plurality of feed belts 27.

After the plurality of feed belts 27 started to move, the control device 63 controls the paper detection sensor 47 to detect whether, the medium is located at a predetermined position on the downstream side of the plurality of central feed belts 42 on the conveying path 5 in the conveying direction 6 (Step S9). If the control device 63 does not detect that a leading end of the medium reaches the predetermined position until a lapse of a designated time since start of movement of the plurality of feed belts 27 (No at Step S9), the control device 63 controls the input-output device 66 to notify the user that an error, has occurred.

If the control device 63 detects that the leading end of the medium reaches the predetermined position (Yes at Step S9), the control device 63 controls the belt driver 61 to stop movement of the plurality of feed belts 27, and controls the shutter driver 62 to locate the first shutter 53-1 at the first closing position and the second shutter 53-2 at the second closing position (Step S10). The plurality of first guide air inlets 56-1 and the plurality of first belt air inlets 43-1 are closed when the first shutter 53-1 is located at the first closing position. The plurality of second guide air inlets 56-2 and the plurality of second belt air inlets 43-2 are closed when the second shutter 53-2 is located at the second closing position. The medium is released from the plurality of feed belts 27 when the plurality of first guide air inlets 56-1, the plurality of first belt air inlets 43-1, the plurality of second guide air inlets 56-2, and the plurality of second belt air inlets 43-2 are closed. The medium released from the plurality of feed belts 27 can be conveyed by the processing unit 12.

If the control device 63 detects that the leading end of the medium reaches the predetermined position, the control device 63 further switches the first side blower 26-1 to the first airflow rate mode and the second side blower 26-2 to the second airflow rate mode (Step S11). After the first side blower 26-1 is switched to the first airflow rate mode and the second side blower 26-2 is switched to the second airflow rate mode, the control device 63 repeatedly performs the processes from Step S3 to Step S11. By repeatedly performing the processes from Step S3 to Step S11, it is possible to appropriately supply the plurality of media stacked on the document table 2 one by one to the processing unit 12.

Figure 10:
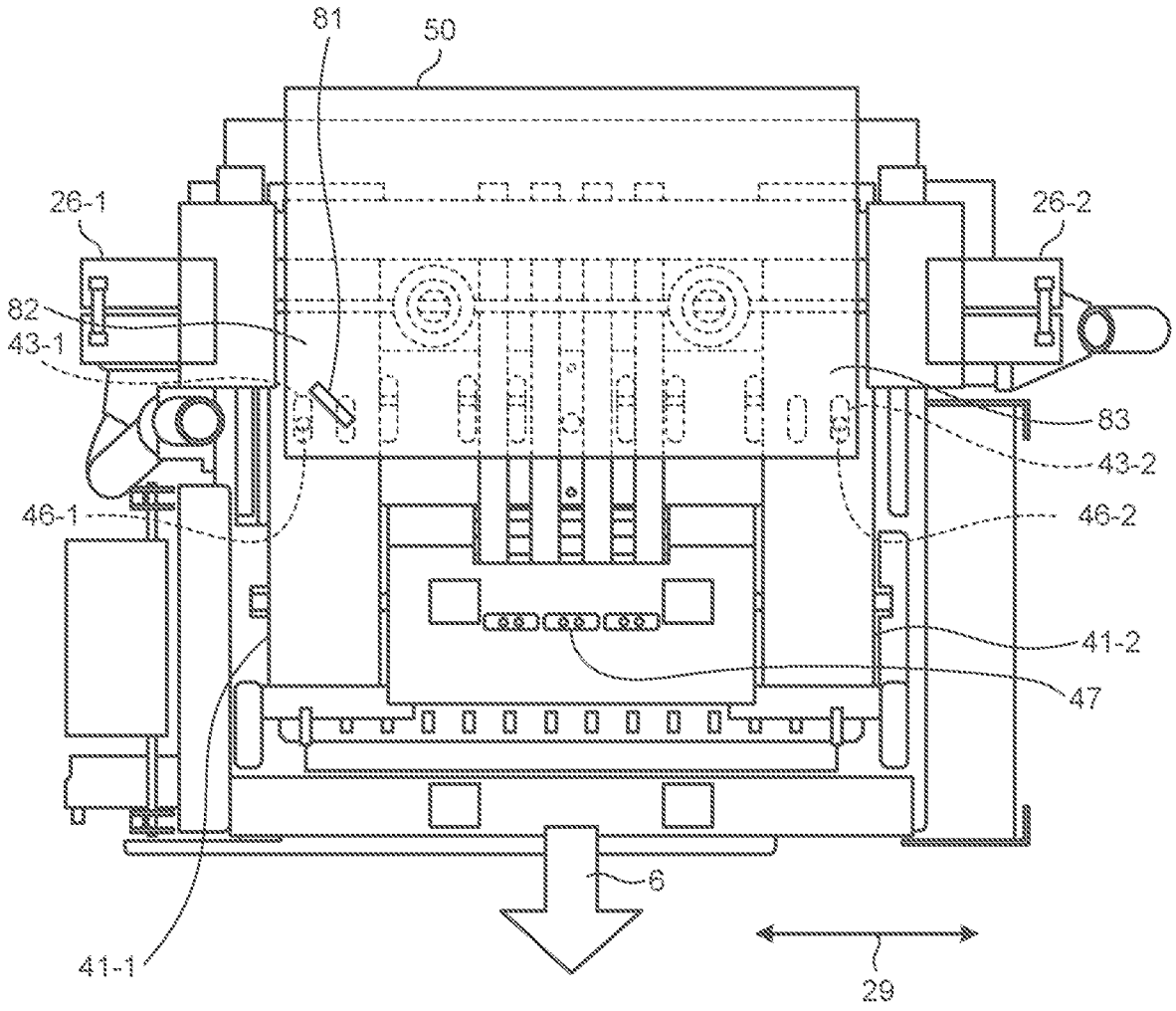
FIG. 10 is a bottom view of the first paper feed unit of the medium conveying apparatus of the first embodiment when a bound medium is moved upward by a plurality of suction pads.

When a bound medium 50 is stacked on the document table 2, the first paper feed unit 11 moves the bound medium 50 up toward the plurality of feed belts 27 by using the plurality of suction pads 32 in the process at Step S3. FIG. 10 is a bottom view of the first paper feed unit 11 of the medium conveying apparatus of the first embodiment when the bound medium 50 is moved upward by the plurality of suction pads 32. The bound medium 50 is formed by binding a plurality of sheets of paper with a staple 81. A bound portion 82 of the bound medium 50 on which the staple 81 is put is arranged in the vicinity of the plurality of first belt air inlets 43-1 of the first feed belt 41-1.

Figure 11:
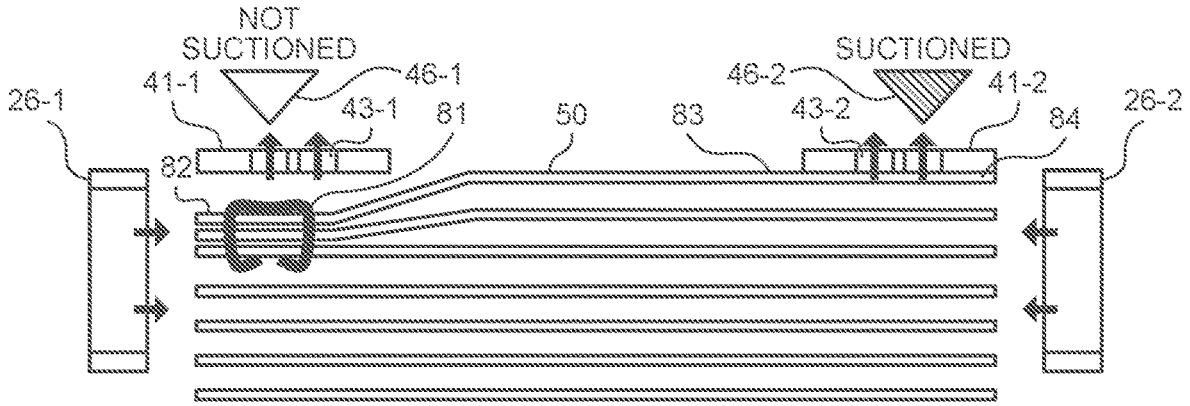
FIG. 11 is a cross-sectional view of the bound medium when a bound portion has not been suctioned to the first feed belt.

Because the bound portion 82 is bound with the staple 81, the bound portion 82 is heavier than a single sheet of paper. So, in some cases, if may be difficult to suction the bound portion 82 to the first feed belt 41-1 even when air is blown at the first air flow rate by the first side blower 26-1 and air is sucked from the plurality of first belt air inlets 43-1. FIG. 11 is a cross-sectional view of the bound medium 50 when the bound portion 82 is not suctioned to the first feed belt 41-1. In this case, a non-bound portion 83 that is not bound with the staple 81 of the bound medium 50 is separated into a plurality of sheets of paper forming the bound medium 50 due to air blown at the second airflow rate by the second side blower 26-2. A sheet of paper 84 on the topmost side of the bound medium 50 is suctioned to the second feed belt 41-2 because the non-bound portion 83 is separated into the plurality of sheets of paper.

Figure 12:
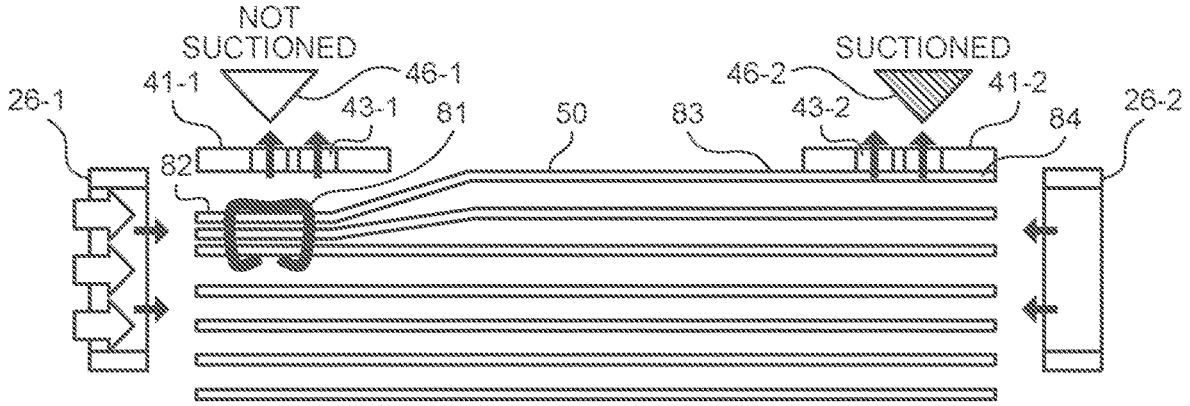
FIG. 12 is a cross-sectional view of the bound medium when a first side blower blows air at a third airflow rate that is greater than a first airflow rate.
Figure 13:
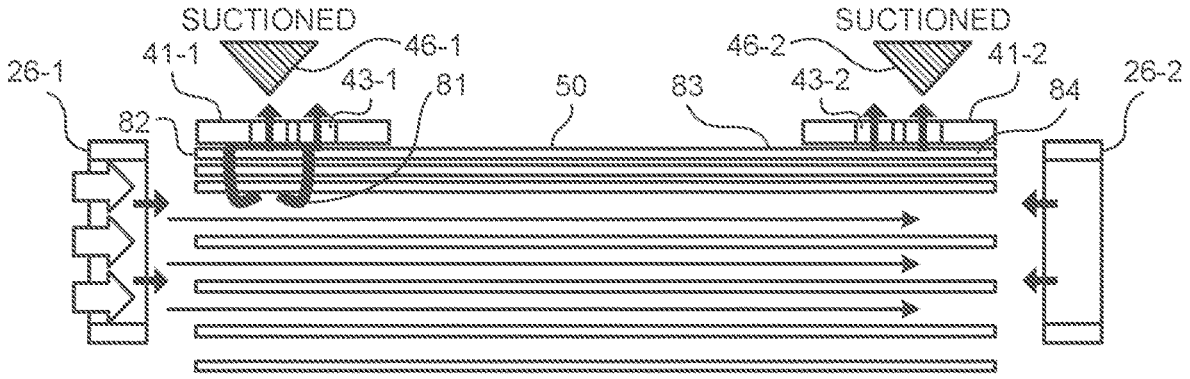
FIG. 13 is a cross-sectional view of the bound medium after a lapse of a predetermined time since the first side blower has blown air at the third airflow rate that is greater than the first airflow rate.

If the first suction detection sensor 46-1 detects that the bound medium 50 is not suctioned to the first feed belt 41-1, the first side blower 26-1 blows air at the third airflow rate that is greater than the first airflow rate. FIG. 12 is a cross-sectional view of the bound medium 50 when the first side blower 26-1 blows air at the third airflow rate that is greater than the first airflow rate. The air blows by the first side blower 26-1 may enter a lower side of the bound portion 32 when the airflow rate is great.

Figure 15:
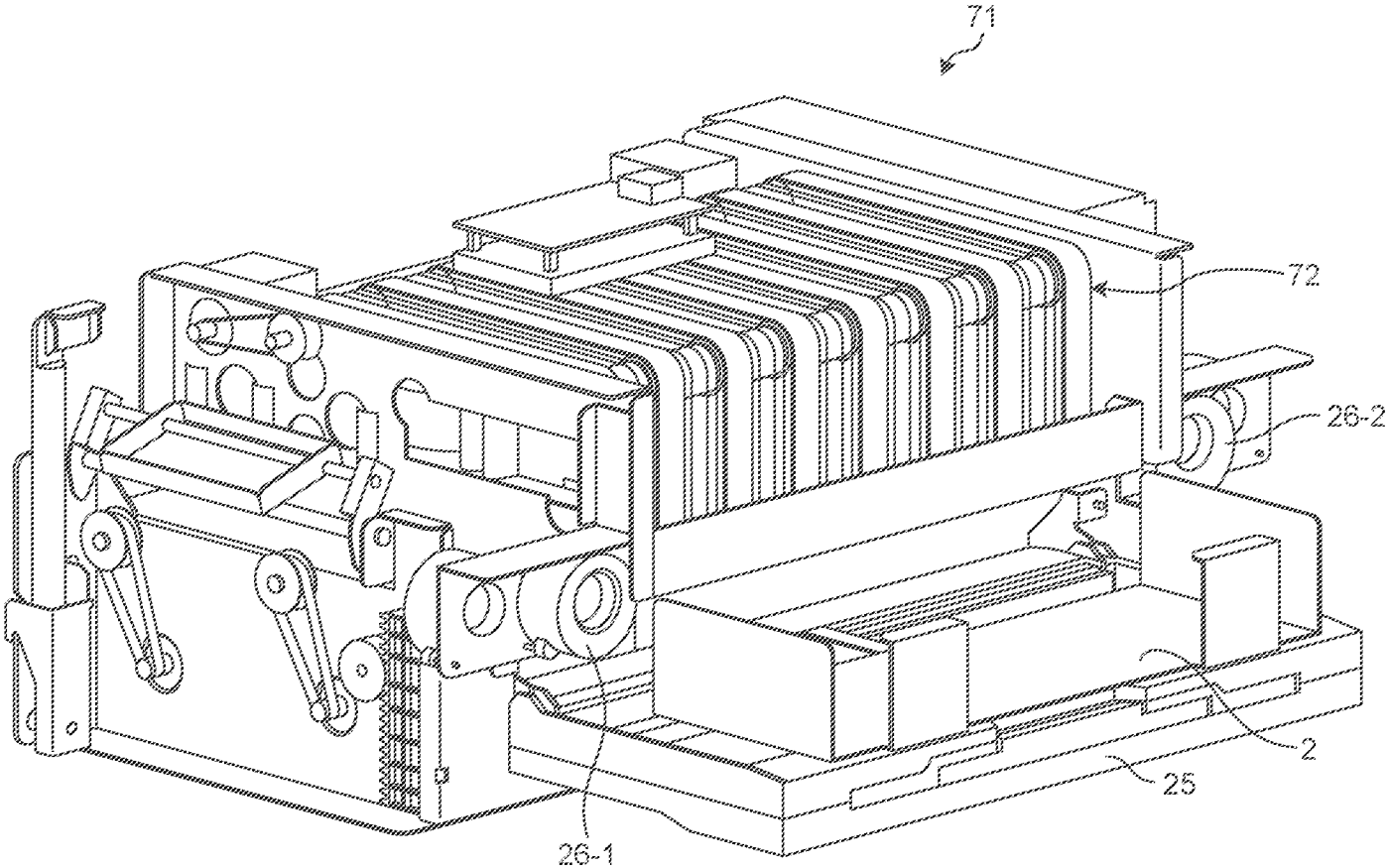
FIG. 15 is a perspective view of a first, paper feed unit of a medium conveying apparatus of a second embodiment.

FIG. 15 is a cross-sectional view of the bound medium 50 after a lapse of a predetermined time since the first side blower 26-1 has blown air at the third airflow rate greater than the first airflow rate. When air is blown at the third airflow rate by the first side blower 26-1, the bound portion 82 of the bound medium 50 may move upward because air enters the lower side of the bound portion 32, and may be suctioned to the first feed belt 41-1. Further, because the third airflow rate of the air blown by the first side blower 26-1 is greater than the second airflow rate of the second side blower 26-2, air blown by the second side blower 26-2 is prevented from entering gaps between the plurality of sheets of paper and the sheets of paper are collected, so that it is possible to appropriately feed the bound medium 50 along with movement of the plurality of feed belts 27.

Figure 14:
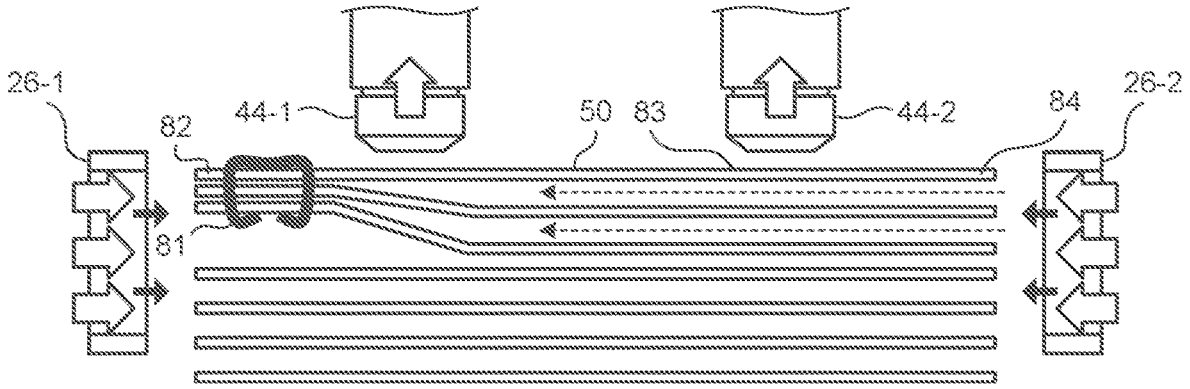
FIG. 14 is a cross-sectional view of the bound medium when the first airflow rate at which air is blown by the first side blower and a second airflow rate at which air is blown by a second side blower blows are equal.

FIG. 14 is a cross-sectional view of the bound medium 50 when both of the first side blower 26-1 and the second side blower 26-2 blow air at the third airflow rate. When air is blown at the third airflow rate by both of the first side blower 26-1 and the second side blower 26-2, air may enter the gaps between the plurality of sheets of paper in the non-bound portion 83 of the bound medium 50. If air enters the gaps between the plurality of sheets of paper, the plurality of sheets of paper in the non-bound portion 83 of the bound medium 50 are separated from one another. If the plurality of sheets of paper in the non-bound portion 33 are separated, in some cases, it may be difficult to appropriately feed the bound medium 50 along with movement of the plurality of feed belts 27.

When auctioning the bound medium 50 to the plurality of feed belts 27, the first paper feed unit 11 is able to cause the bound medium 50 to be suctioned appropriately to the plurality of feed belts 27 by increasing the airflow rate at which air is blown to the bound portion 82 as compared to an airflow rate at which air is blown to the non-bound portion 83. The first paper feed unit 11 is able to appropriately feed the bound medium 50 by causing the bound medium 50 to be suctioned appropriately to the plurality of feed belts 27.

Effects of Medium Conveying Apparatus of First Embodiment

The medium conveying apparatus of the first embodiment includes the plurality of feed belts 27, the conveying blower 35, the belt driver 61, the first side blower. 26-1, the second side blower 26-2, the first auction detection sensor 46-1, the second suction detection sensor 46-2, and the controller. The conveying blower 35 causes a single medium among a plurality of media stacked on the document table 2 to be suctioned to the plurality of feed belts 27. The belt driver 61 moves the plurality of feed belts 27 to feed the medium while the medium is being suctioned to the plurality of feed belts 27. The first side blower 26-1 blows air to a first end face of the medium. The second side blower 26-2 blows air to a second end face formed on an opposite side of the first end face of the medium. The first suction detection sensor 46-1 detects whether the medium has been suctioned to the first feed belt 41-1 located close to the first end face among the plurality of feed belts 27. The second suction detection sensor 46-2 detects whether the medium has been suctioned to the second feed belt 41-2 located close to the second end face among the plurality of feed belts 27. If it is detected that the medium has been suctioned to the second feed belt 41-2 and has not been suctioned to the first feed belt 41-1, the control device 63 controls the first side blower 26-1 such that an airflow rate at which air is blown to the first end face is changed. The changed airflow rate is greater than an airflow rate at which air is blown to the first end face by the first, side blower 26-1 before the change, and is greater than an airflow rate at which air has been blown to the second end face by the second side blower 26-2. The medium conveying apparatus as described above is able to cause the bound medium 50 to be suctioned appropriately to the plurality of feed belts 27 and feed the bound medium 50.

Furthermore, if air is blown to the first end face at the changed airflow rate and it is detected that the medium is not suctioned to the first feed belt 41-1, the control device 63 of the medium conveying apparatus of the first embodiment changes the airflow rate of the first side blower 26-1 to a certain airflow rate that is greater than the changed airflow rate. The medium conveying apparatus as described above is able to reliably cause the bound medium 50 to be suctioned to the plurality of feed belts 27 and feed the bound medium 50.

Moreover, if it is detected that the medium has been suctioned to the first feed belt 41-1 and has not been suctioned to the second feed belt 41-2, the control device 63 of the medium conveying apparatus of the first embodiment changes the airflow rate at which air is blown to the second end face. The changed airflow rate at which air is blown to the second end face is greater than the airflow rate at which air is blown to the first end face by the first side blower 26-1, and is greater than the airflow rate at which air is blown to the second end face by the second side blower 26-2 before the change. The medium conveying apparatus as described above is able to cause the bound medium 50 to be suctioned appropriately to the plurality of feed belts 27 oven when a binding member for binding the bound medium 50 is arranged in the vicinity of the second feed belt 41-2.

Furthermore, the medium conveying apparatus of the first embodiment further includes the plurality of suction pads 32 to which the medium is suctioned by contacting with the medium, and the suction pad driver 33 that moves the plurality of suction pads 32. The control device 63 controls the suction pad driver 33 such that the medium comes into contact with the plurality of suction pads 32 when the medium is not suctioned to the plurality of suction pads 32, and such that the medium being suctioned to the plurality of suction pads 32 contacts with the plurality of feed belts 27. The medium conveying apparatus as described above is able to cause the medium to be suctioned appropriately to the plurality of feed belts 27 and feed the medium.

Second Embodiment

The medium conveying apparatus of the first embodiment-, as described above includes the plurality of suction pads 32, but the plurality of suction pads 32 may be omitted. As illustrated in FIG. 15, a medium conveying apparatus of a second embodiment is configured such that, the first paper feed unit 11 of the medium conveying apparatus of the first embodiment as described above is replaced with a different first paper feed unit 71, and other components are the same as those of the medium conveying apparatus of the first embodiment as described above. FIG. 15 is a perspective view of the first paper feed unit 71 of the medium conveying apparatus of the second embodiment. The first paper feed unit 71 is configured such that the plurality of suction pads 32, the suction pad driver 33, and the plurality of suction pad blowers 34 of the first paper feed unit 11 of the medium conveying apparatus of the first embodiment as described above are omitted and the plurality of feed belts 27 are replaced with plurality of different feed belts 72.

Figure 16:
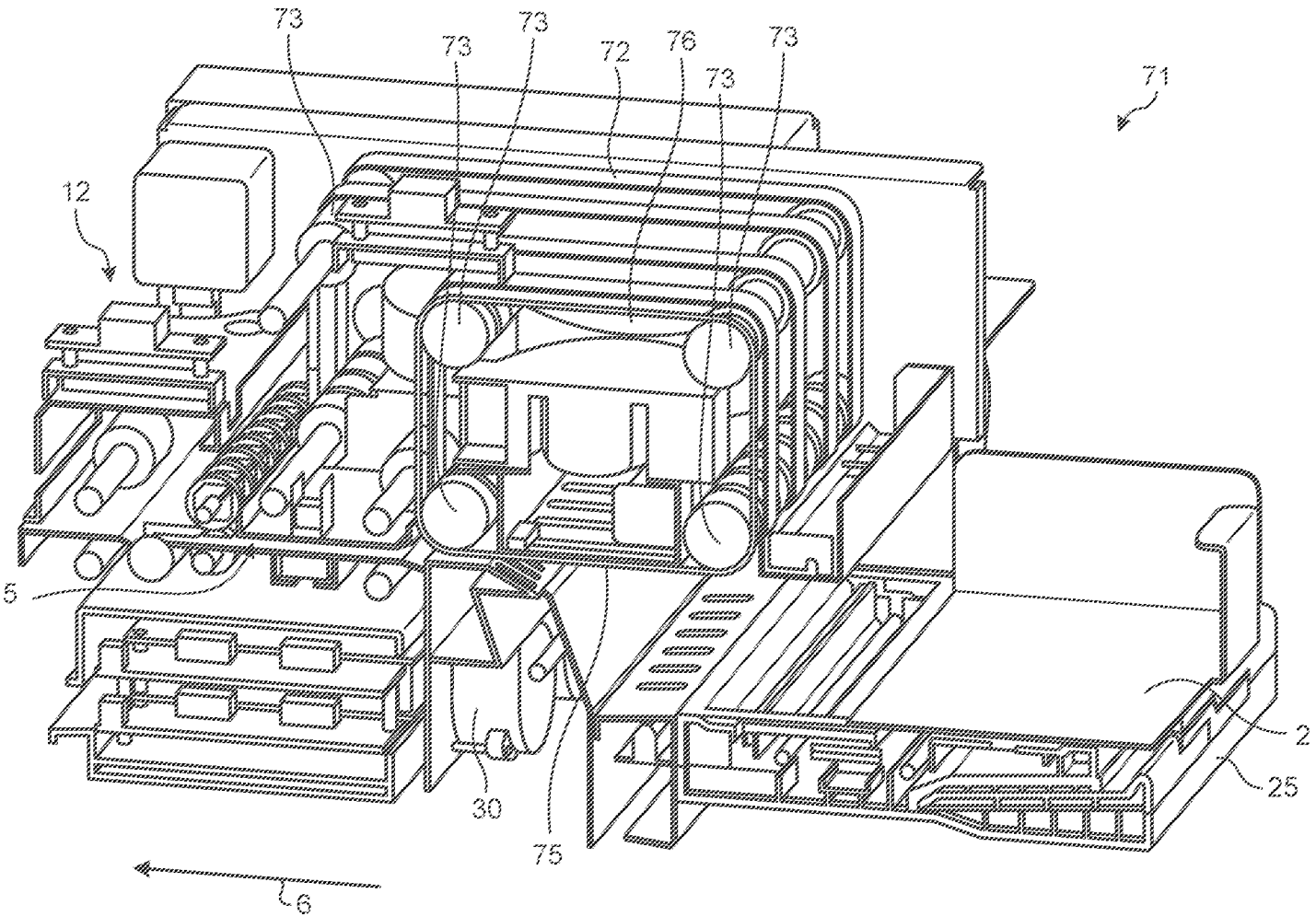
FIG. 16 is a cross-sectional view of the first paper feed unit of the medium conveying apparatus of the second embodiment.

FIG. 16 is a cross-sectional view of the first paper feed unit 71 of the medium conveying apparatus of the second embodiment. The first paper feed unit 71 is further configured such that the plurality of fixed pulleys 31 of the first paper feed unit 11 of the medium conveying apparatus of the first embodiment as described above are replaced with a plurality of different fixed pulleys 73. The plurality of feed belts 72 are stretched around the plurality of fixed pulleys 73, and accordingly, a lower portion 75 is formed. The lower portion 75 separates an area 76 enclosed by the plurality of feed belts 72 and a space between the plurality of feed belts 72 and the document table 2.

The first, paper feed unit 71 is further configured such that the lower portion 75 is located along another plane that is parallel to a plane along a stacking surface of the document table 2 on which a medium is stacked. The first paper feed unit 71 is able to cause the medium stacked on the document table 2 and the lower portion 75 to fully come close to each other by moving the document table 2 upward. By causing the medium and the lower portion 75 to fully come close to each other, the first paper feed unit 71 is able to cause the medium stacked on the document table 2 to foe suctioned to the lower portion 75 by sucking air by the conveying blower 35. Therefore, the medium conveying apparatus of the second embodiment is able to cause the bound medium 50 to be suctioned appropriately to the plurality of feed belts 72 and feed the bound medium 50, similarly to the medium conveying apparatus of the first embodiment as described above.

Third Embodiment

Each of the first side blower 26-1 and the second side blower 26-2 of the medium conveying apparatus of the embodiments as described above is switched between modes to change an airflow rate, but need not always be switched between modes. K medium conveying apparatus of a third embodiment is configured in the same manner as a medium conveying apparatus of the first embodiment as described above. In this case, the first side blower 26-1 is fixed to the third airflow rate mode and the second side blower 26-2 is fixed to the second airflow rate mode. When a user attempts to read images from the bound medium 50 by using an image reading apparatus including the medium conveying apparatus of the third embodiment, the user stacks a plurality of media on the document table 2 such that the bound portion 82 faces the first side blower 26-1 side. Similarly to the medium conveying apparatus of the embodiments as described above, the bound medium 50 is suctioned appropriately to a plurality of feed belts of the medium conveying apparatus of the third embodiment because an airflow rate at which air is blown to an end face at the side of the bound portion 82 is greater than an airflow rate at which air is blown to an end face on the opposite side. Therefore, the medium conveying apparatus of the third embodiment is able to cause the bound medium 50 to be suctioned appropriately to the plurality of feed belts and feed the bound medium 50, similarly to the medium conveying apparatus of the embodiments as described above.

Figure 17:
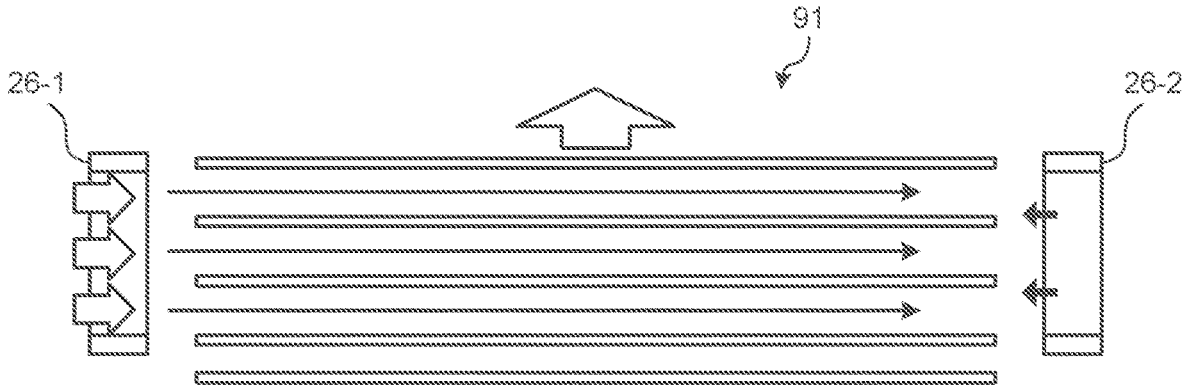
FIG. 17 is a cross-sectional view of a plurality of media when a first side blower and a second side blower of a medium conveying apparatus of a third embodiment blows air to both end faces of the media.

FIG. 17 is a cross-sectional view of a plurality of media 91, for which air is blown to both end faces by the first side blower 26-1 and the second side blower 26-2 of the medium conveying apparatus of the third embodiment. In the medium conveying apparatus of the third embodiment, even when the plurality of media 91 formed of non-bound media are stacked on the document table 2, air is blown to the both end faces, and therefore, air is appropriately blown into gaps between the plurality of media 91. The medium conveying apparatus of the third embodiment is able to appropriately separate the plurality of media 91 by appropriately blowing air into the gaps between the plurality of media 91. Therefore, the medium conveying apparatus of the third embodiment is able to cause a single medium arranged on the topmost side among the plurality of media 91 to be suctioned appropriately to the plurality of feed belts and feed the medium.

The medium conveying apparatus of the embodiments as described above is used in the image reading apparatus, but may be used in a different apparatus. Examples of the different apparatus include a printer. For example, when the medium conveying apparatus is used in a printer, the reading unit 13 is replaced with a printing device. Even when the medium conveying apparatus is used in an apparatus different from the image reading apparatus, it is possible to appropriately feed the bound medium 50 by using the plurality of feed belts.

The medium conveying apparatus disclosed herein is able to feed a bound medium appropriately.

All examples and conditional language recited herein are intended for pedagogical purposes of aiding the reader in understanding the disclosure and the concepts contributed by the inventor to further the art, and are not to be construed as limitations to such specifically recited examples and conditions, nor does the organization of such examples in the specification relate to a showing of the superiority and inferiority of the disclosure. Although the embodiments of the disclosure have been described in detail, it should be understood that the various changes, substitutions, and alterations could be made hereto without departing from the spirit and scope of the disclosure.

What is claimed is:

1. A medium conveying apparatus comprising:

a feed belt;

a suctioner with which a medium of a plurality of media stacked on a document table is suctioned to the feed belt;

a driver that moves the feed belt to feed the medium when the medium is being suctioned to the feed belt;

a first side blower that blows air at a first airflow rate to a first end face of the medium;

a second side blower that blows air at a second airflow rate to a second end face opposite to the first end face of the medium;

a first sensor that detects whether the medium has been suctioned to a first portion of the feed belt close to the first end face;

a second sensor that detects whether the medium has been suctioned to a second portion of the feed belt close to the second end face; and a controller that controls the first side blower to blow air at a third airflow rate greater than the first airflow rate and the second airflow rate to the first end face when the second sensor detects that the medium has been suctioned to the second portion and the first sensor detects that the medium has not been suctioned to the first portion, wherein the suctioner includes:

a suction pad that contacts with the medium and suctions the medium; and an actuator that moves the suction pad, and wherein the controller controls the actuator such that the suction pad contacts with the medium when the medium has not been suctioned to the suction pad and such that the medium contacts with the feed belt when the medium has been suctioned to the suction pad.

2. The medium conveying apparatus according to claim 1, wherein when air is blown at the third airflow rate to the first end face and the first sensor detects that the medium has not been suctioned to the first portion, the controller controls the first side blower to blow air to the first end face at a certain airflow rate that is greater than the third airflow rate.

3. The medium conveying apparatus according to claim 1, wherein when the first sensor detects that the medium has been suctioned to the first portion and the second sensor detects the medium has not been suctioned to the second portion, the controller controls the second side blower to blow air to the second end face at a certain airflow rate that is greater than the first airflow rate and the second airflow rate.

4. A medium conveying apparatus comprising:

a feed belt;

a suctioner with which a medium of a plurality of media stacked on a document table is suctioned to the feed belt, the suctioner including i) a suction pad that contacts with the medium and suctions the medium and ii) an actuator that moves the suction pad;

a driver that moves the feed belt to feed the medium when the medium is being suctioned to the feed belt;

a non-bound side blower that blows air to a non-bound end face of the medium;

a bound side blower that blows air to a bound end face opposite to the non-bound end face of the medium at a certain airflow rate that is greater than an airflow rate at which air is blown to the non-bound end face by the non-bound side blower; and a controller that controls the actuator of the suctioner such that the suction pad contacts with the medium when the medium has not been suctioned to the suction pad and such that the medium contacts with the feed belt when the medium has been suctioned to the suction pad.

* * * * *